US005462508A

United States Patent [19]

Schiavone

[11] Patent Number: 5,462,508

[45] Date of Patent: Oct. 31, 1995

[54] CALF CRUNCHER EXERCISE EQUIPMENT

[76] Inventor: Robert J. Schiavone, 410 Union Valley Rd., Mahopac, N.Y. 10541

[21] Appl. No.: 388,946

[22] Filed: Feb. 15, 1995

[51] Int. Cl.[6] ..... A63B 21/02

[52] U.S. Cl. ..... 482/122; 482/904; 482/92

[58] Field of Search ..... 482/91, 10, 121, 482/122, 148, 904, 907, 39, 40, 135, 92, 111, 112, 124, 128, 129, 130, 131, 133, 134, 139

[56] References Cited

U.S. PATENT DOCUMENTS 3,118,441 1/1964 George ..... 482/122
4,372,551 2/1983 Yurdin ..... 482/135
4,844,448 7/1989 Niznik ..... 482/904
5,033,741 7/1991 Ganzer ..... 482/128

*Primary Examiner*—Stephen R. Crow
*Attorney, Agent, or Firm*—Martin S. Spellman, Jr.

[57] ABSTRACT

An exercise apparatus is disclosed having a pair of laterally spaced clamps adjustably secured to the upper edges of a door frame opening. A shaft depends downwardly from each clamp and the shafts are connected together by a horizontal bar. The shafts have extending sliding shaft portions with adjustable tension portions connected to each sliding shaft for resisting upward movement of the sliding shafts. The sliding shafts include lower ends having concavely curved shoulder engaging portions, wherein a user's upward movement is resisted by the tension portions of the sliding shafts.

6 Claims, 5 Drawing Sheets

FIG.5
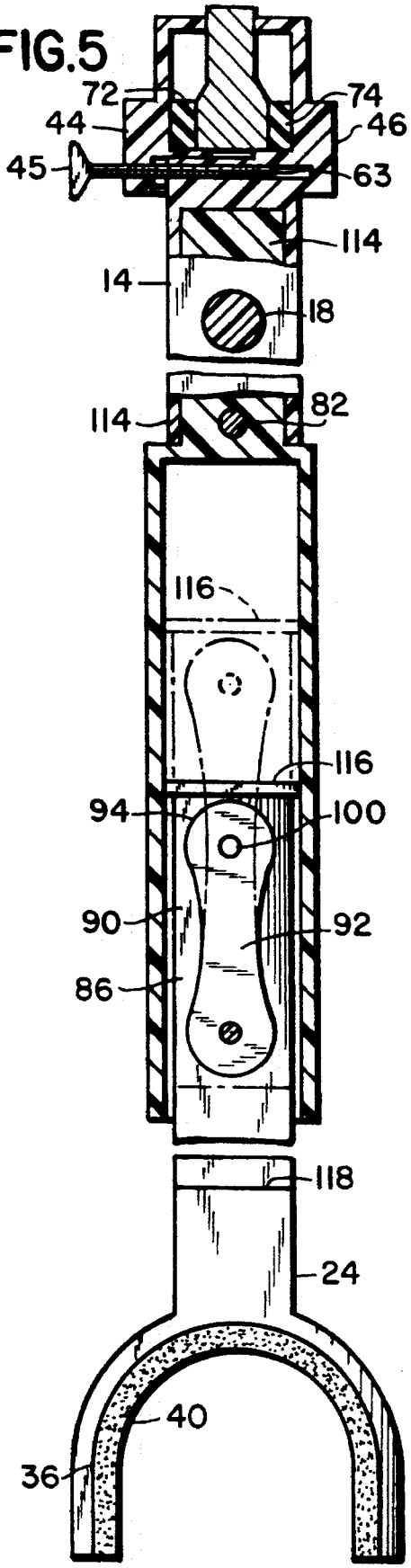
FIG.6
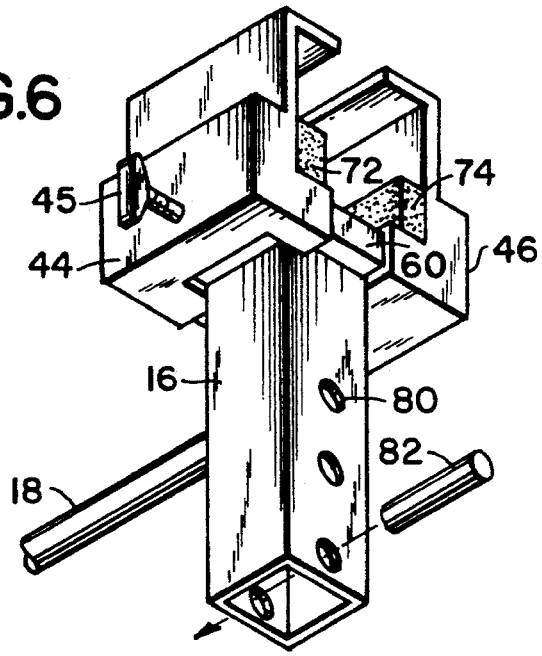
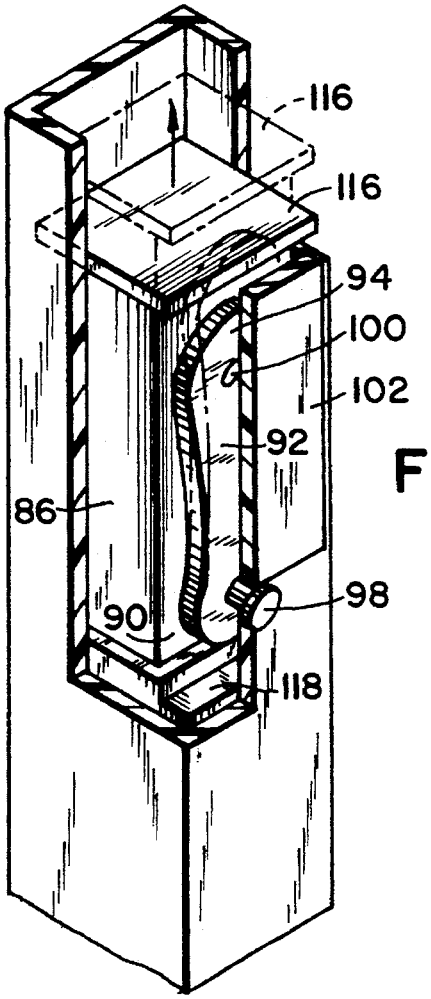
FIG.7

5
4
8
10
45
47
2
14
16
18
18
20
22
116
100
116
94
104
100
88
86
102
98
96
91
5
118
24
28
32
26
30
34

CALF CRUNCHER EXERCISE EQUIPMENT

BACKGROUND OF THE INVENTION

1. Field of the Invention

This invention is concerned with exercise equipment more particularly exercise equipment for strengthening a user's muscles, in particular, calf muscles. The apparatus of the present invention is specially designed to be adapted for utilization in a residential environment by clamping the apparatus to an upper doorway frame or similar structure. The apparatus is clamped to a upper door frame and curved shoulder pads depending from the apparatus are engagible by the user's shoulders. The user then pushes upwards with his leg muscles against the tensioned resistance of elements of the apparatus. It is especially useful for strengthening calf muscles by the user standing upright and rising up on his toes or balls of the feet against the resistance of the apparatus.

2. Prior Art

In U.S. Pat. No. 5,288,283 Meeker there is disclosed a doorway exerciser especially designed for infants who have not yet started to walk but are approaching that stage of development. In this case a scissors-like spring biased clamp secures the device over an upper door frame. A depending strap, adjustable in length and removeably secured to the clamp, is provided. The lower end of the strap is secured to a sling in which an infant sits with the legs dangling below. The length is adjusted so that the infant's feet may touch the floor and the strap has an extensible spring so that the baby can bounce up and down, pushing off the floor against its own weight.

In U.S. Pat. No. 4,109,907 Zito a home weight lifting exercise device is disclosed which comprises a pair of clamps having depending flanges from which hang a pair of pulleys each of which carries a cord having weighted bags at one end and handles at the other end. The user can utilize the device for building up arm muscles by pulling against the weight of the bags. It allows variable positioning and movement of the arms. Essentially it is a block and tackle type of apparatus with associated weights and hand grips.

Various other exercise devices which can be attached to home door frames are disclosed in the following patents, none of which are particularly adapted for strengthening leg muscles, and especially calves. In addition, most of the devices are considerably more elaborate, complex, and expensive to manufacture when compared to Applicant's relatively simple device which is easily manufactured, mounted, and utilized.

U.S. Pat. No. 4,896,881 DjerdJerian discloses cable type exercise machine with a frame designed to be secured to the door frame by clamps as shown. This utilizes pulleys and handle bars against which weights at the opposite end of the cord running over the pulley are pulled.

U.S. Pat. No. 4,747,594 Houde discloses an elaborate exercise device that is secured to a door frame. It utilizes a collapsible seat and again, is primarily a pulley type exercise device.

A stand up exerciser that may be secured to a door frame by a clamp is disclosed in U.S. Pat. No. 4,844,448 Niznick. It has a depending frame removably mounted to the clamp and beneath the doorway with a rotatable padded bar. Tension spring means connect the clamp to the frame at intermediate ends. This is not particularly useful for exercising the legs. It can be utilized as a guide in doing squats but there is no possibility in doing foot rises to strengthen calf muscles.

Another variation of home exerciser devices using hydraulic shock absorbers to provide variable resistive forces is shown in U.S. Pat. No. 4,275,882 Grosser et al. A bench is utilized and there is no conception of a simple leg exercise device.

In U.S. Pat. No. 4,618,140 Brown the apparatus is secured to a vertical surface and comprises a combination of handle bar and hydraulic cylinder providing a resistive force.

U.S. Pat. No. 5,176,602 Roberts shows an exercise device suspended from a door frame and simply provides spaced apart depending pulleys on each corner of the upper door frame with a cord secured therein with handle grips at each end for the user to pull back and forth against his own resistance.

The prior art shows nothing to suggest the simple and economical apparatus disclosed herein which is specifically designed for strengthening larger leg muscles, particularly calf muscles.

SUMMARY OF THE INVENTION

In accordance with the present invention a simple and economical home exercising apparatus is provided which is directed towards strengthening the leg muscles, especially the calf muscles, of the user. The apparatus may be clamped easily to the upper door frame moldings of a residence and suspended downwardly therefrom. A pair of laterally spaced clamps are removably secured to the door frame and depending therefrom is a pair of adjustable length shafts having lower extensions with slidable portions having with tension means resisting upward movement against the strength of the user. The lower ends of these shafts are connected to spaced apart concavely curled, padded shoulder engaging brackets which are placed over the users shoulder. The user then pushes upwardly, preferably primarily with his calf muscles by rising up on the balls of his feet.

The length of the shafts can be adjusted to extend further downwardly to adjust for the user's height as well as controlling the position of the user's legs when initially engaging the shoulder brackets. The lower the brackets are during the exercise, the more the user's legs are bent at the knees and hips, and in such instances the device is particularly useful for developing upper leg muscles, the thighs. As the cylinder is shortened, the shoulder pads will engage the user's shoulders when the user is in a fully upright position and he exercises by rising up on the balls of his feet thereby particularly strengthening the calf and foot muscles.

Optionally, the depending shafts may be hingedly suspended by the door clamps.

BRIEF DESCRIPTION OF THE DRAWING

In the accompanying drawing which forms a part of this specification:

FIG. 5 is a side view, partially in section, of the device showing the operation of the tension resistance means and the clamps;

FIG. 6 is a perspective view taken from a bottom side view of the door frame connecting means;

FIG. 7 is a perspective view, partially cut away showing the operation of the resistance tension device.

ILLUSTRATIVE SPECIFIC EMBODIMENT

Figure 1:
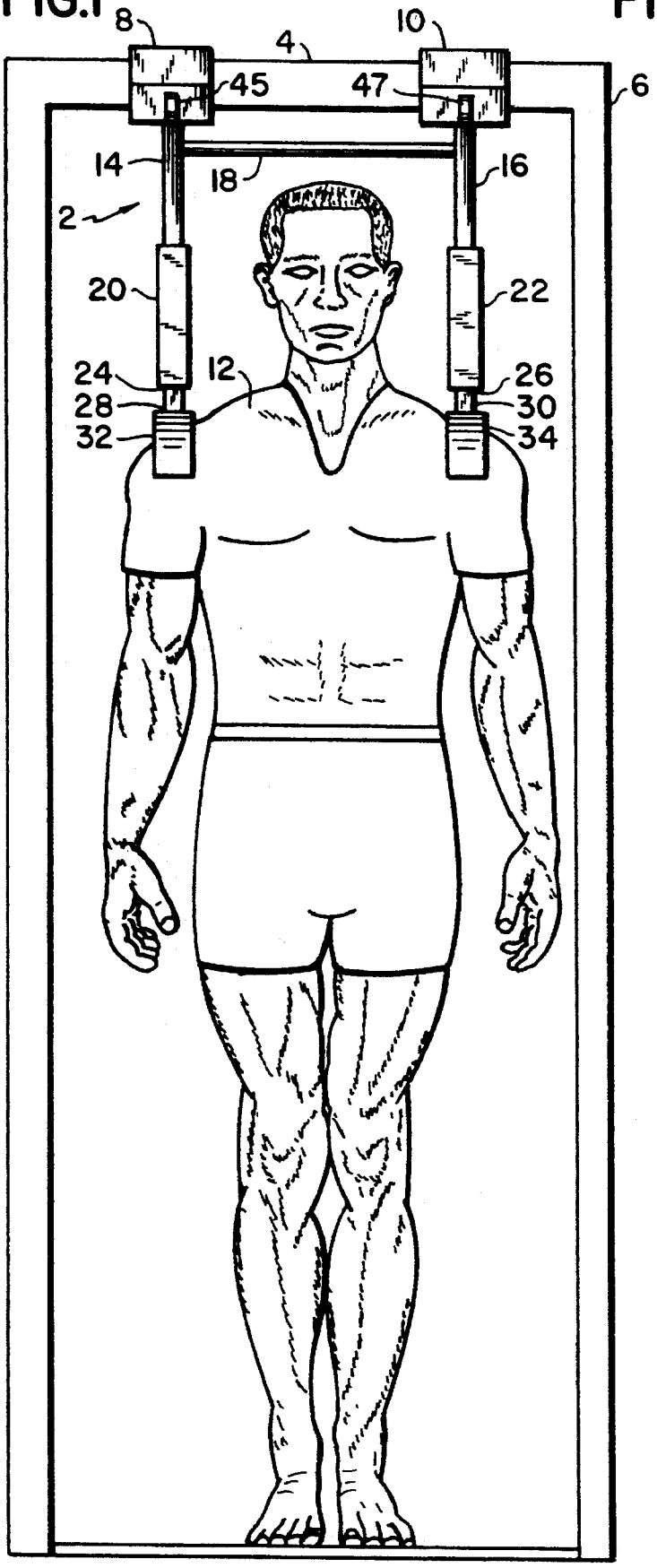
FIG. 1 is a front plan view showing the device of the present invention secured to a door frame and a user in place with the device.
Figure 2:
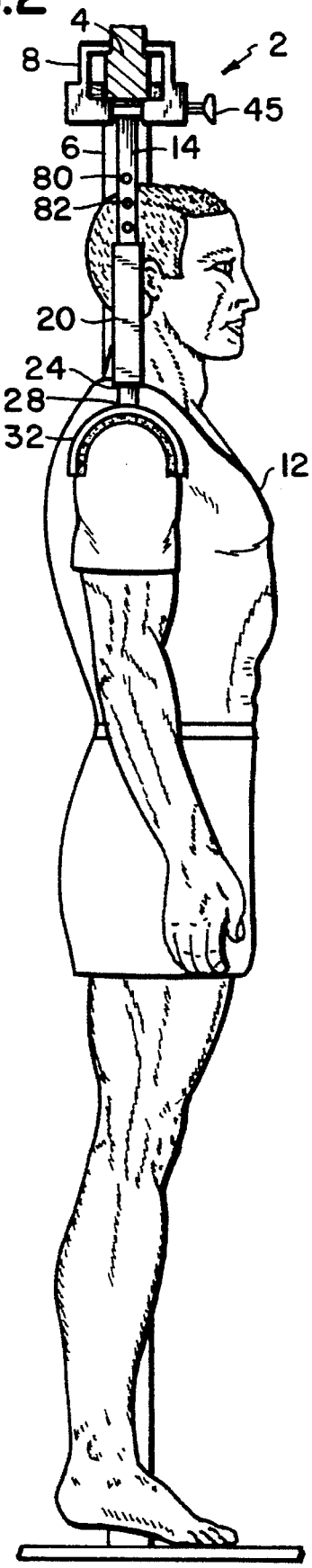
FIG. 2 is a right plan view partially in section of the device.

In the accompanying drawing a user 12 of the apparatus 2 herein is shown exercising calf muscles in FIGS. 1 and 2.

The apparatus 2 of the present invention is shown secured to the upper portion 4 of door frame 6 by mean of the adjustable frame clamps 8 and 10.

Pivotally depending from the brackets 8 and 10 are adjustable length frame members 14 and 16 which are connected to each other by means of the horizontal bar 18.

Figure 9:
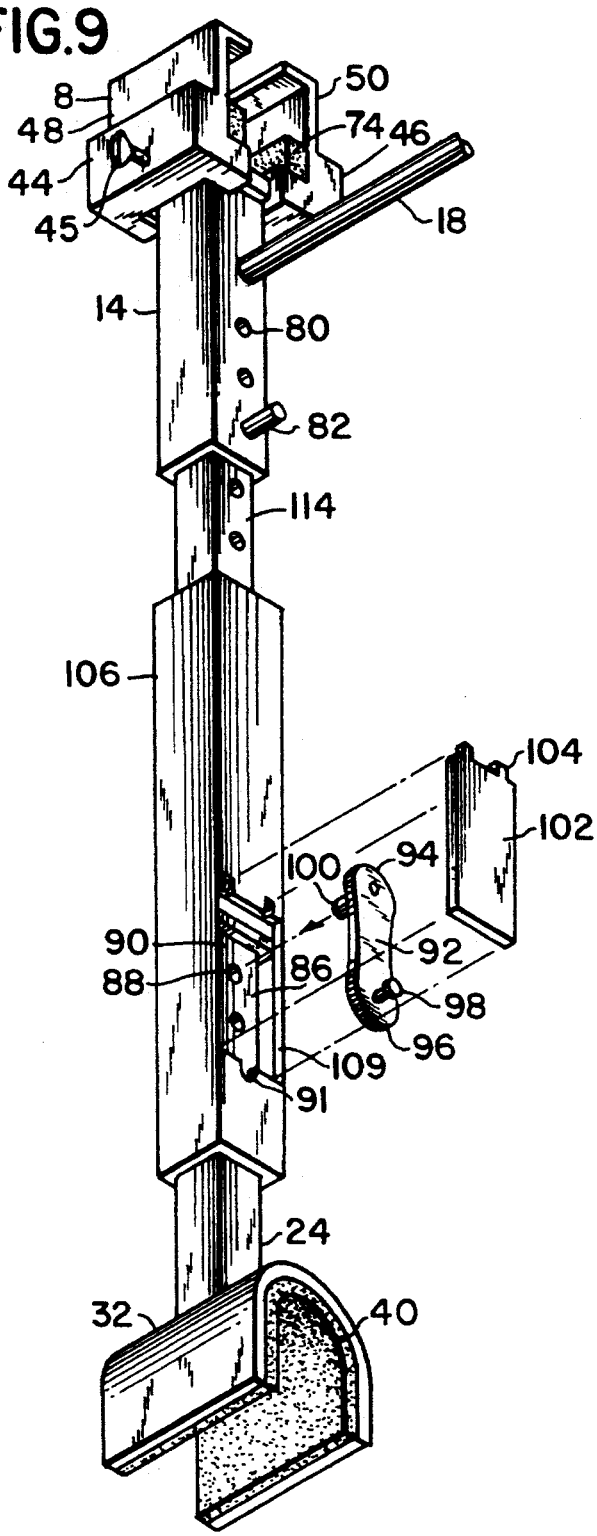
FIG. 9 is a perspective view showing the length adjusting mechanism and tensioning components.
Figure 10:
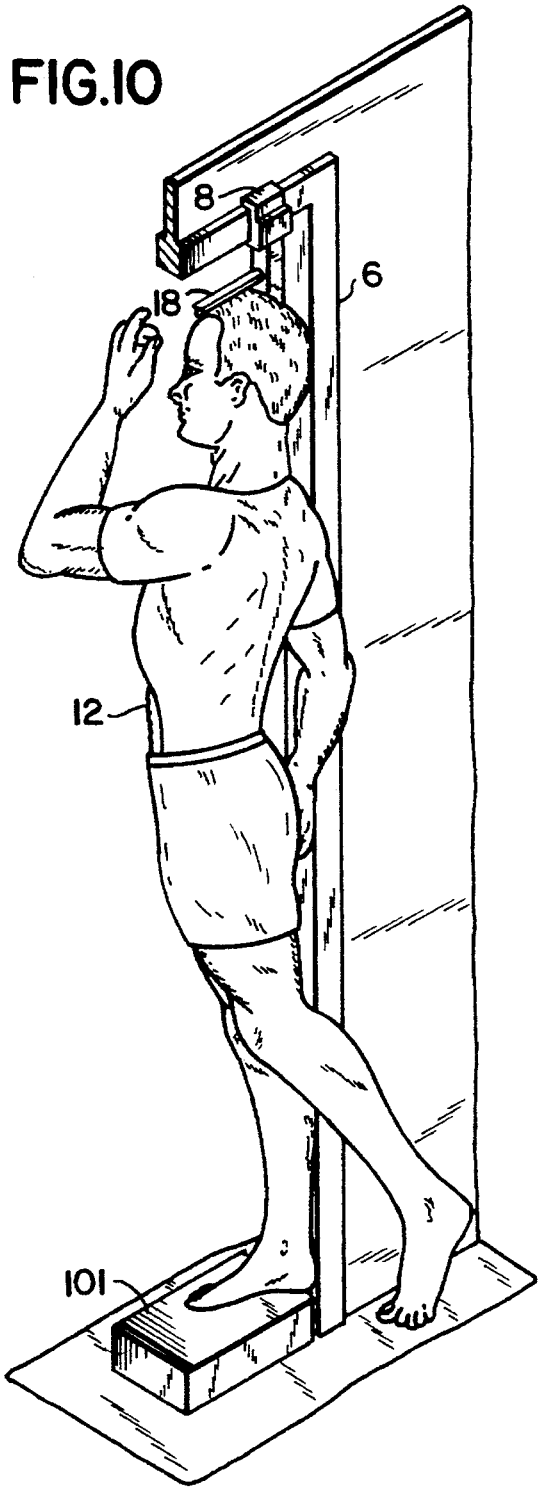
FIG. 10 is a perspective view of a user stepping onto a step block optionally used in conjunction with the device.

Depending brackets 14 and 16 are adjustable in length as best shown in FIGS. 6 and 9. The shaft enclosures 20 and 22 which contain the adjustable tension means 4.

Sliding within the enclosures 20 and 22 are downwardly extending bracket members 24 and 26 respectively, which at their base 28 and 30 are secured to the concavely curved shoulder engaging members 32 and 34 respectively. Shoulder engaging members 32 and 34 on their inner curved sides are fitted with padded a cushioning substance such as rubber or a foamed plastic which is adhesively secured to the inner curved sides. The member 32 is shown in FIGS. 3, 4, 5, and 9 with its inner side 36 fitted with the rubber cushion 40. Member 34 is the same. Brackets 8 and 10 which are of identical construction, are each comprised of clamp members 44 and 46 which have upright sides 48 and 50 and opposed inwardly extending horizontal upper sections 52 and 54 which are intended to fit over the typical door frame casing 4 as best shown in FIG. 5.

Figure 3:
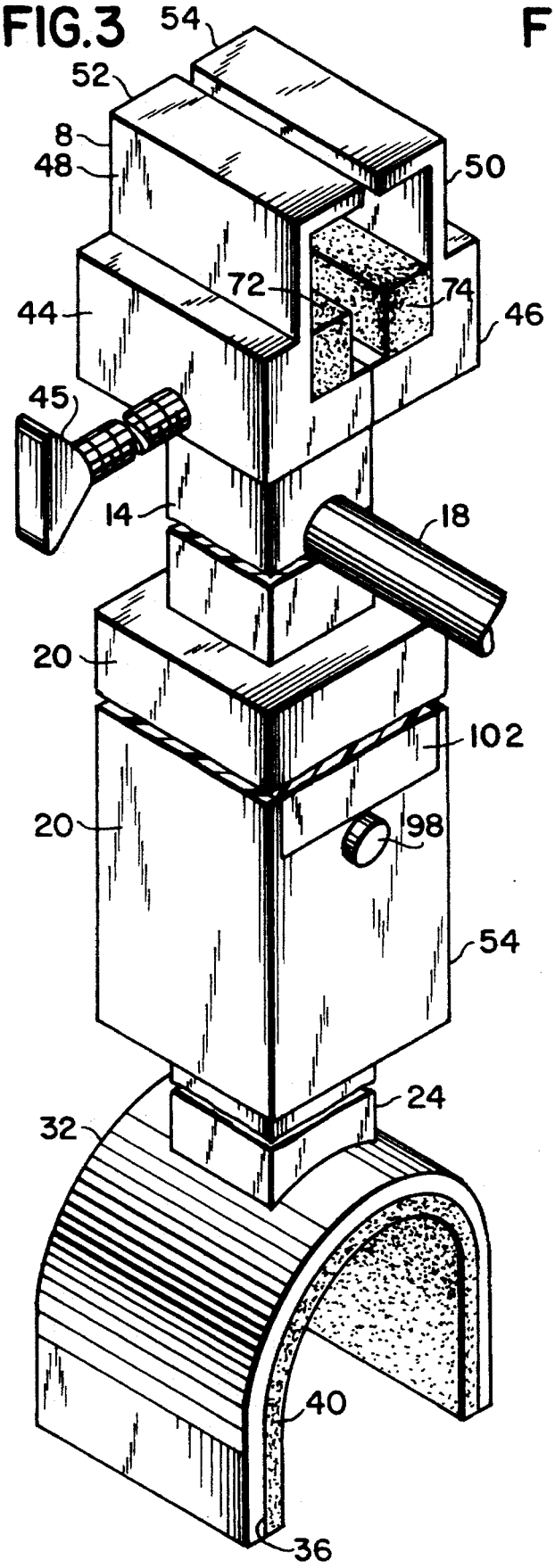
FIG. 3 is an enlarged perspective view of one side half of the device with the clamping means closed.
Figure 4:
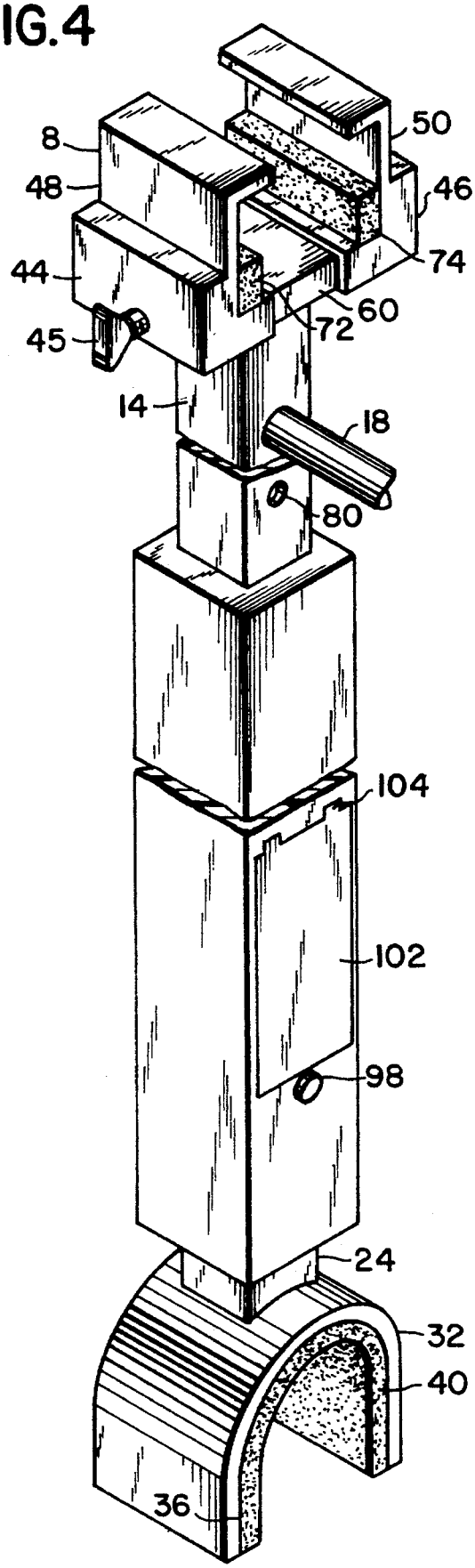
FIG. 4 is a similar, but on a smaller scale, perspective view of the device with the clamping jaws open.

In FIG. 3 the members 44 and 46 are shown close together in a closed position.

Base sections 56 and 58 engage and are built around a base 60. The sections 56 and 58 are adjustable towards each other and away from each other by turning of the threaded shaft 63 which passes through the assembly as best shown in FIG. 5 drawing the members 44 and 46 forward or away from each other by the shaft 63 engaging threads in the sections 56 and 58 as shown. Knob 45 and 47 are placed at the outer end of each shaft of 63 for facility in making adjustments.

The lower inner faces of the members 44 and 46 are provided with rubber or similar elastic or sponge-like material 72 and 74 glued thereto, respectively, which engage the surfaces of the upper door frame 4 and prevent them from being marred.

Turning to lower extension 14 it is to be understood that the corresponding shaft 16 is same as shown in FIGS. 5, 6, and 9. Shaft 14 is provided on the innerface thereof with apertures 80 in which peg 82 is placed to correspond with similar apertures in the inner shaft section 114 which is adjustably slidable within the enclosure 14 thereby allowing the length of the downwardly extending shaft 114 to be adjusted as best illustrated in FIG. 9. The internal shaft 14 as best shown in FIG. 5 extends downwardly and defines an enclosure within which the lower extension 86 slides up and down under tension. Inner shaft part 86 extends up to stop 116 and the innerface thereof 90 has apertures 88 therein for receiving a peg 100 of the rubber tension strap 92. The upper end 94 of the tension strap 92 has an inwardly extending peg 100 which is placed in one of the apertures 88 on the face 90 of part 96 and the lower end 96 thereof has extension peg 98 which extends into the recess cut out 91 of the outer shell 106 of the slidable shaft 114. A door 102 has recessed nibs 104 fitting to corresponding recesses in the shaft 106. Thus saying as the lower portion of shaft 86 is pushed up by the user, the rubber tension strip 92 will be stretched upwardly as best shown in FIG. 5 resisting the upward movement of the user. Shoulders 118 formed in the lower end of the shaft 86 serve as downward straps.

Figure 8:
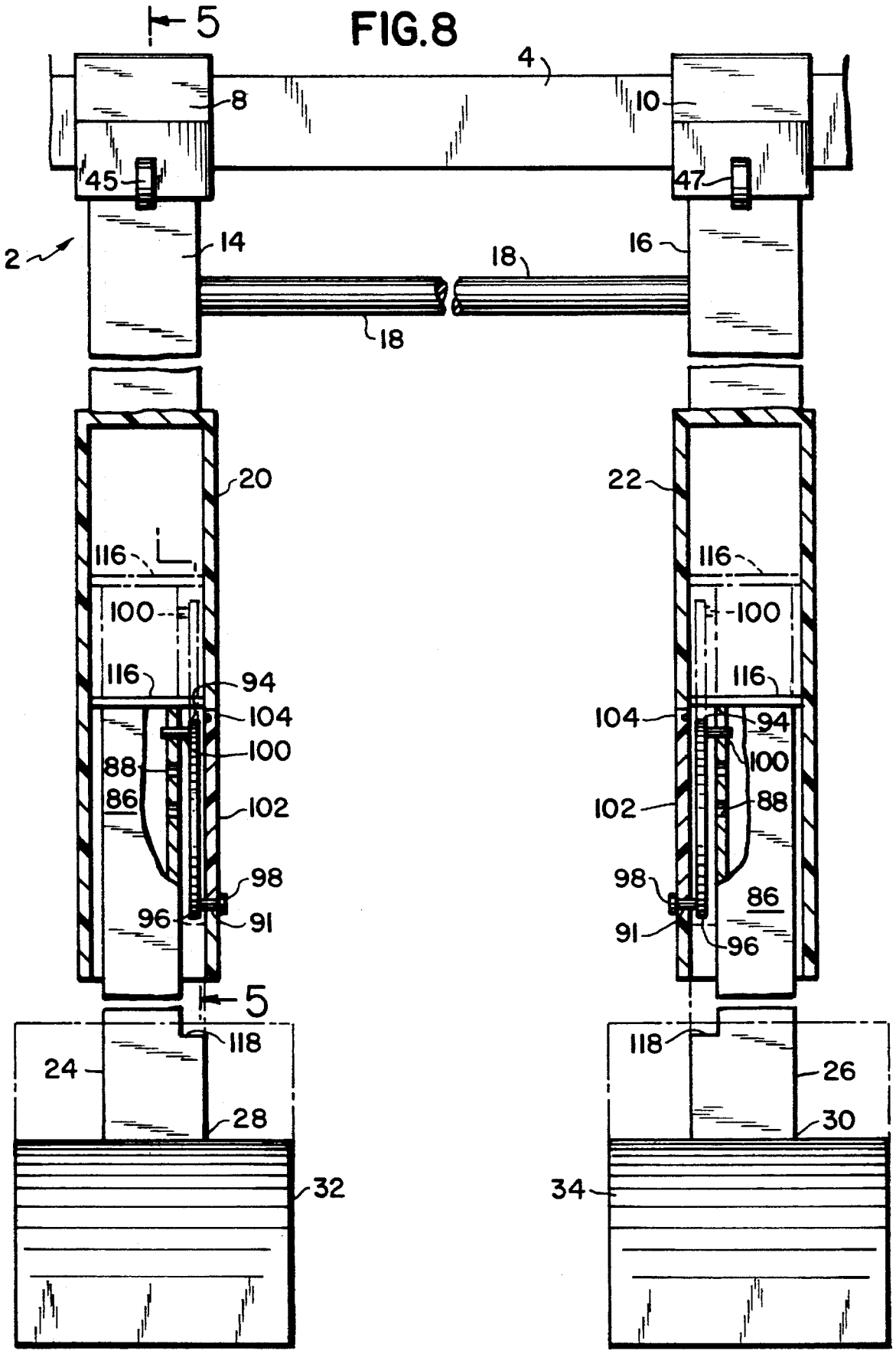
FIG. 8 is an enlarged front plan view of the device partially cut away showing the tension mechanism and movement thereof as well as the adjusting means for the degree of tension.

Shown best in FIGS. 6, 7, and 8 the dog bone shaped elastic member 92 at its lower end 96 has a pin 98 extending through apertures 91 which in the lower wall as best shown in FIG. 8. The other end 94 has a pin 100 extending into apertures 88 in the wall 90 of the member 24. Additional apertures 88 in the wall of the member 24 are provided for adjusting the tension.

The user 12 clamps the device 2 to the upper frame 4 of a doorway 6, adjusting the length of the depending arms 14 and 16 so that with the user 12, standing under the apparatus 2 the members 30 and 32 gently engage the shoulders of the user 12. The user 12 then can utilize the device 2 for exercising by rising on his toes as illustrated in FIG. 2 forcing the arm 24 and 26 upward into the positions in FIG. 8. To increase the tension a step stool 101 may be utilized or pin adjustments made.

Optionally, the user 12 may grasp the bar 18 and use it as a conventional chinning bar.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. An exercise apparatus for strengthening leg and foot muscles, said apparatus comprising a pair of laterally spaced clamping means adapted for adjustably secured to the upper edge of a door frame opening, shaft means depending downwardly from each of said clamping means and being connected together by a horizontal bar means, said depending shaft means having downwardly extending sliding shaft means at their lower ends which said sliding shaft means normally resting in an extended downward position, adjustable tension means connected to said sliding shaft means for resisting upward movement of said sliding shaft means, lower ends of said sliding shafts having downwardly extending concavely curved shoulder engaging means adapted to fit over the shoulders of a user standing below said apparatus and to be pushed upwardly by said user's upward movement, said upward movement being resisted by said tension means on said sliding shafts.

2. An exercise apparatus as claimed in claim 1 wherein said downwardly extending shaft means are adjustable in their lengths.

3. An exercise apparatus as claimed in claim 1 wherein the tension of the sliding shaft means may be adjusted to increase or decrease the effort needed to move said sliding shaft means upwardly.

4. An exercise apparatus as claimed in claim 1 wherein said concavely curved shoulder engaging means is faced with padding.

5. An exercise apparatus as claimed in claim 1 where said tension means is an extendable rubber member.

6. An exercise apparatus as claimed in claim 2 wherein the tension of the sliding shaft means may be adjusted to increase or decrease the effort needed to move said slidable shaft means upwardly and said concavely curved shoulder engaging means is faced with padding.

* * * * *